United States Patent [19]

Carlson et al.

[11] Patent Number: 4,457,036

[45] Date of Patent: Jul. 3, 1984

[54] DEBRIS COLLECTING MECHANISM

[75] Inventors: Alfred D. Carlson, Robbinsdale, Donald J. Haub, Champlin; Mark E. Snetting, Minneapolis, all of Minn.

[73] Assignee: Tennant Company, Minneapolis, Minn.

[21] Appl. No.: 416,655

[22] Filed: Sep. 10, 1982

[51] Int. Cl.[3] ..... A47L 11/16

[52] U.S. Cl. ..... 15/49 R; 15/50 R; 15/87; 15/320; 15/385

[58] Field of Search ..... 15/49 R, 50 R, 98, 83, 15/87, 320, 385, 79 R, 79 A, 340

[56] References Cited

U.S. PATENT DOCUMENTS

| | | | |
|---|---|---|---|
| 21,868 | 10/1858 | Barnett . | |
| 348,778 | 9/1886 | Reynolds . | |
| 548,201 | 10/1895 | Hvass . | |
| 563,869 | 7/1896 | Mueller, Jr. . | |
| 670,926 | 4/1901 | Cameron . | |
| 778,427 | 12/1904 | Noll . | |
| 1,510,880 | 10/1924 | Aitken . | |
| 1,687,728 | 10/1928 | Liddell . | |
| 1,750,829 | 3/1930 | Wilson . | |
| 1,773,993 | 8/1930 | Gillis . | |
| 1,979,797 | 11/1934 | Finnell . | |
| 2,142,933 | 1/1939 | Bickford . | |
| 2,199,703 | 5/1940 | Hough . | |
| 2,236,814 | 4/1941 | Evans . | |
| 2,248,699 | 7/1941 | Finnell . | |
| 2,358,119 | 9/1944 | Wilson . | |
| 2,589,311 | 3/1952 | Turner . | |
| 2,655,678 | 10/1953 | Keogh . | |
| 2,657,408 | 11/1953 | Machovec . | |
| 2,680,260 | 6/1954 | Danielsson et al. | 15/50 R |
| 2,683,885 | 7/1954 | Johnson . | |
| 2,708,280 | 5/1955 | Antos et al. . | |
| 2,712,142 | 7/1955 | Newcomer . | |
| 2,859,461 | 11/1958 | Machovec . | |
| 2,950,494 | 8/1960 | Dickson . | |
| 2,960,708 | 11/1960 | Dear et al. . | |
| 2,972,159 | 2/1961 | Swanson et al. . | |
| 2,987,741 | 6/1961 | Feldman et al. . | |
| 3,064,292 | 11/1962 | Fillery . | |
| 3,105,991 | 10/1963 | Oberg . | |
| 3,115,654 | 12/1963 | Zimmerman . | |
| 3,218,657 | 11/1965 | Jepson . | |
| 3,277,511 | 10/1966 | Little et al. . | |
| 3,401,417 | 9/1968 | Moughty et al. . | |
| 3,458,885 | 8/1969 | Danielsson . | |
| 3,490,090 | 1/1970 | Harrison . | |
| 3,491,395 | 1/1970 | McCandless . | |
| 3,639,936 | 2/1972 | Ashton . | |
| 3,701,177 | 10/1972 | Meyer et al. . | |
| 3,837,157 | 9/1974 | Van Der Lely . | |
| 3,866,541 | 2/1975 | O'Connor et al. . | |
| 3,911,518 | 10/1975 | Momy . | |
| 3,952,361 | 4/1976 | Wilkins . | |
| 3,987,512 | 10/1976 | Meyerhoefer . | |
| 3,996,636 | 12/1976 | Ashton . | |
| 4,006,506 | 2/1977 | Burgoon . | |
| 4,009,500 | 3/1977 | Ashton . | |
| 4,141,567 | 8/1977 | Burgoon . | |
| 4,369,540 | 1/1983 | Burgoon et al. | 15/49 R |

*Primary Examiner*—Edward L. Roberts

*Attorney, Agent, or Firm*—Merchant, Gould, Smith, Edell, Welter & Schmidt

[57] ABSTRACT

In a combination sweeping, polishing and scrubbing floor maintenance machine, the present invention includes a debris hopper removably positioned in a frame secured to a portion of the machine. The debris hopper has a rearward opening facing a pair of substantially side-by-side disc tools, e.g. brushes. The brushes preferably rotate in the same rotational direction with one brush positioned slightly ahead of the other brush. Immediately in front of the forward edge of the leading brush is a conduit means secured to the hopper. Adjacent the conduit means and extending along the hopper opening is a flexible member. Both the flexible member and the conduit means serve as debris receiving means for directing swept debris upwardly into the debris hopper. Blade members may be provided forward of the debris receiving means and beneath the hopper to guide debris into a central area of the machine's path of travel.

32 Claims, 9 Drawing Figures

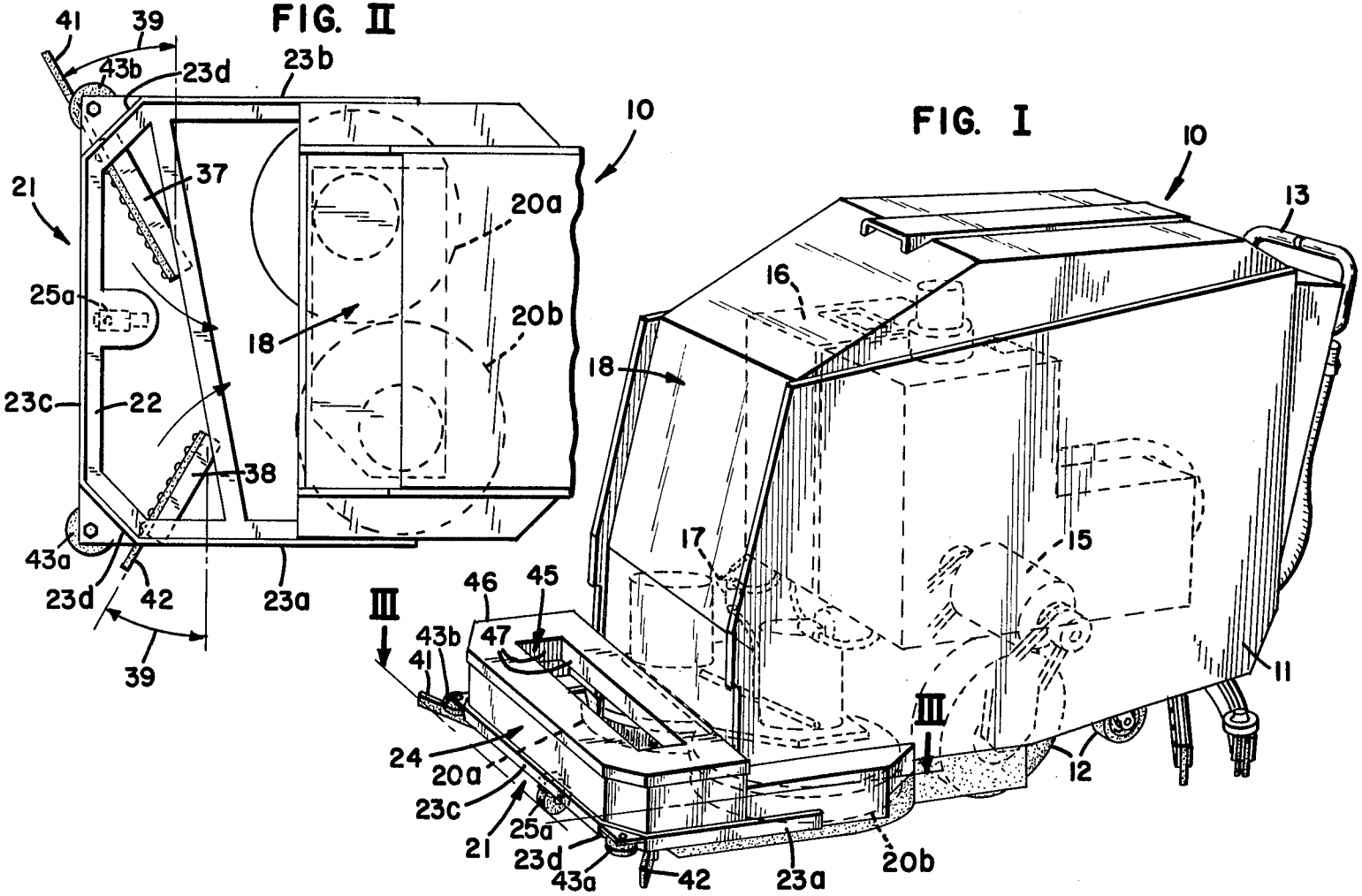
FIG. I
FIG. II
10
11
12
13
15
16
17
18
20a
20b
21
22
23a
23b
23c
23d
24
25a
37
38
39
41
42
43a
43b
45
46
47
III

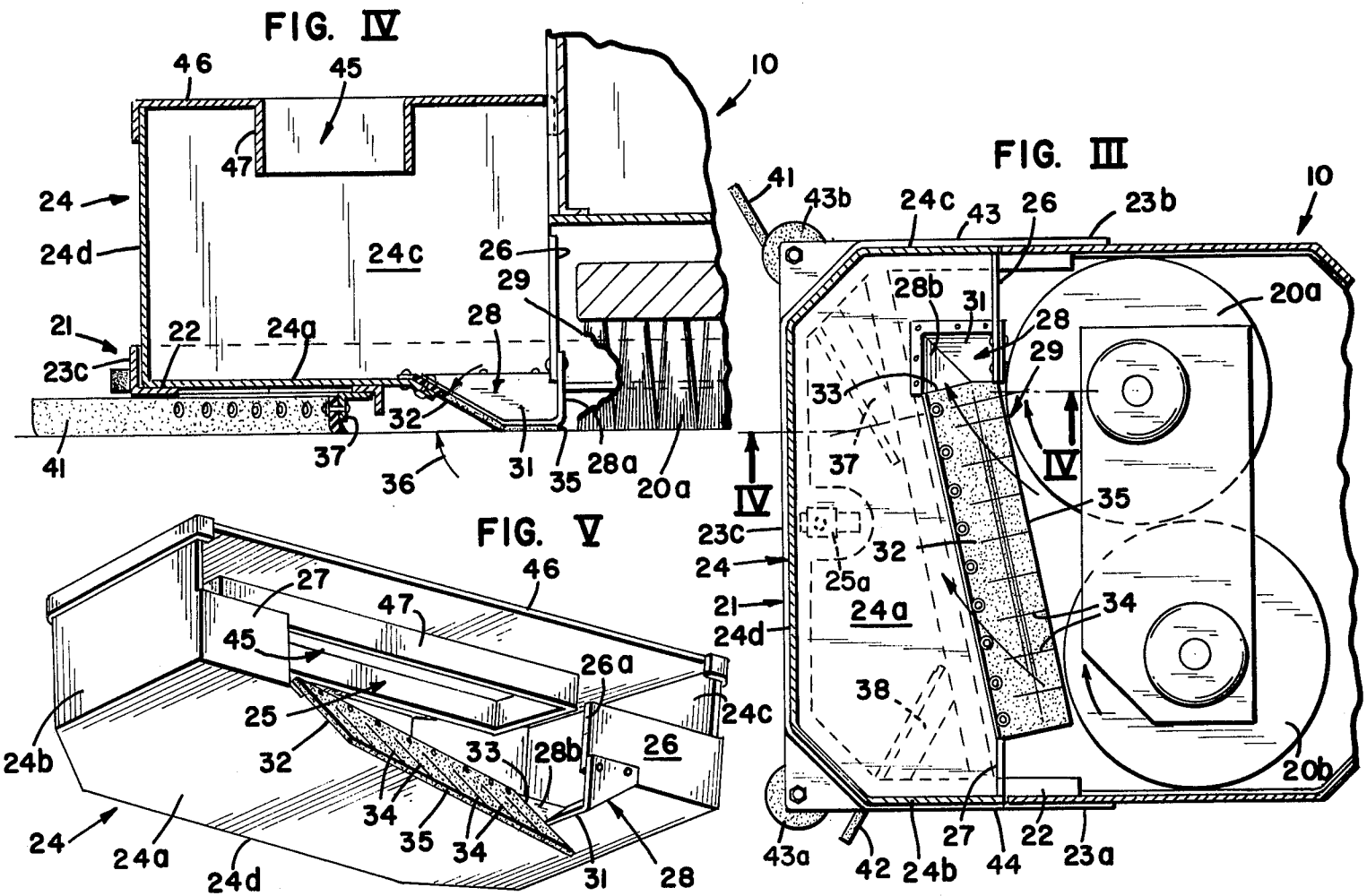
FIG. III
FIG. IV
FIG. V
10
20a
20b
23a
23b
23c
22
24
24a
24b
24c
24d
21
25
25a
26
26a
27
28
28a
28b
29
31
32
33
34
35
36
37
38
41
42
43
43a
43b
44
45
46
47

FIG. VI
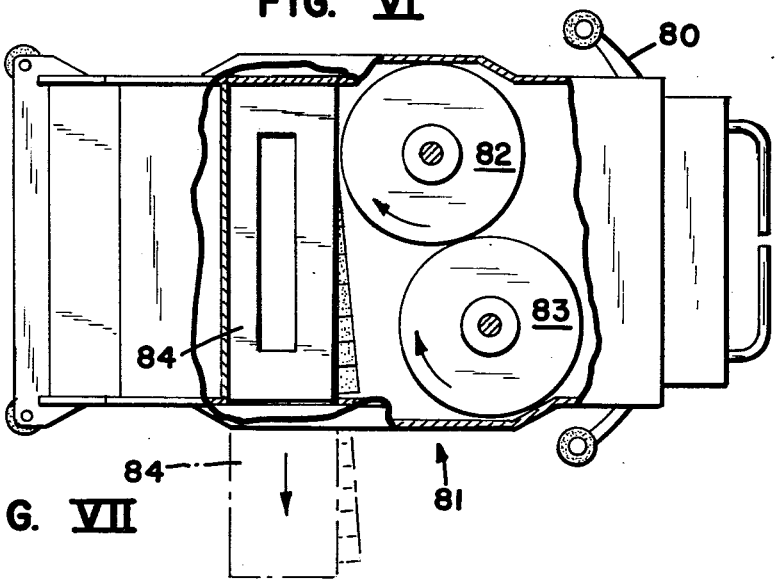
FIG. VII
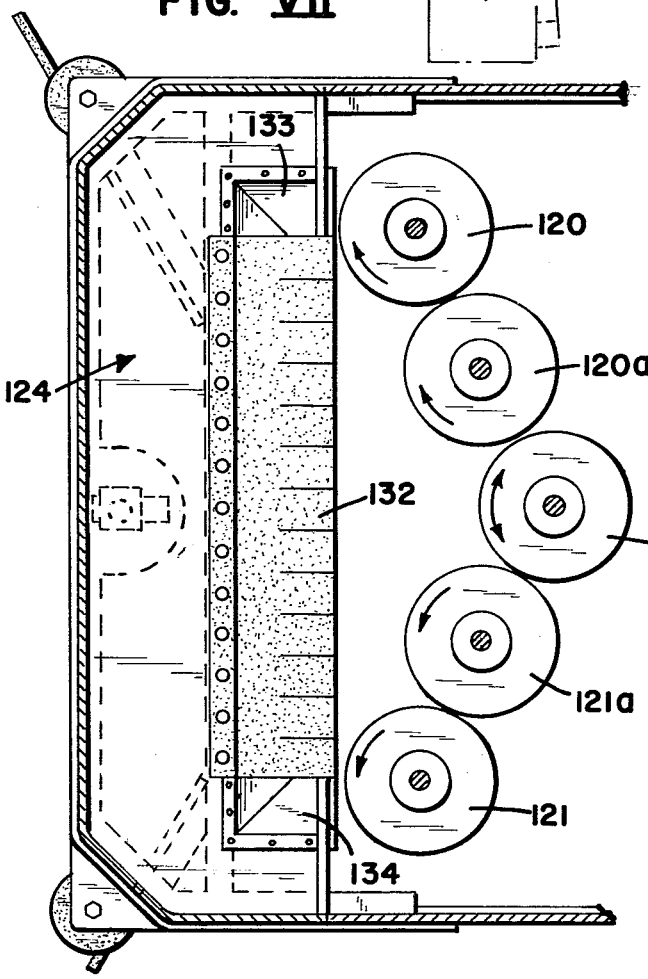
FIG. VIII
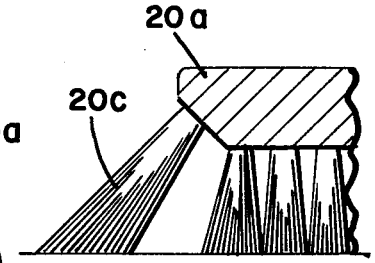

FIG. IX
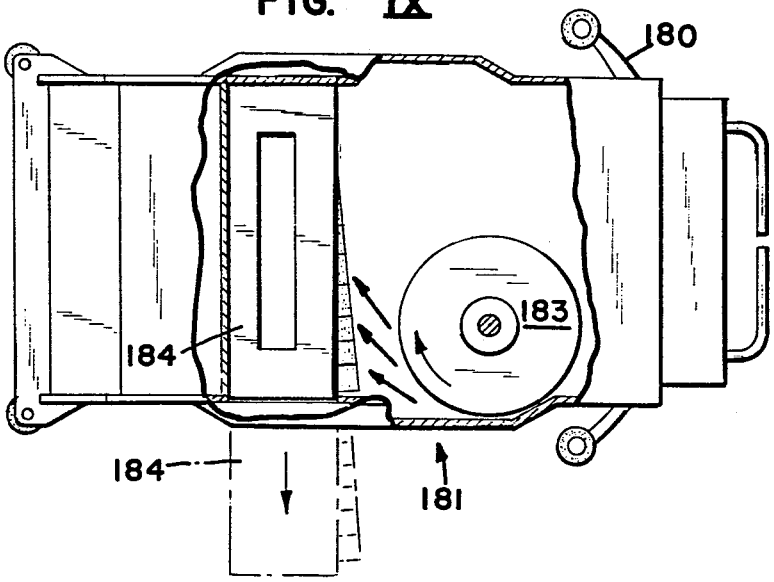

DEBRIS COLLECTING MECHANISM

TECHNICAL FIELD

The present invention relates to surface maintenance equipment, and more particularly to machines which simultaneously sweep and scrub a floor surface.

BACKGROUND OF THE INVENTION

Numerous maintenance machines are available which either sweep or scrub a floor surface or which simultaneously sweep and scrub a surface in one operation. As used herein, the terms "surface", "floor surface" "maintained surface" and the like will be used to designate or represent those surfaces which require maintenance, such as the floors of buildings (e.g. warehouses), as well as the surfaces of outdoor facilities (e.g. streets, sidewalks, and parking lots). These floor maintenance machines may be either riding units or walk-behind units. Typically, a maintenance machine has a body supported on wheels which are propelled along the floor surface by a motor. A variety of cylindrical brushes may be employed as well as disc brushes. It is to be recognized that cylindrical brushes, rotating about a horizontal axis, have the ability to lift or impart vertical motion to the debris thereby assisting the debris into the hopper. Disc brushes on the other hand rotate on a vertical axis with little vertical motion. Disc brushes are very effective for scrubbing purposes but do not tend to sweep or load debris as effectively as cylindrical brushes. Generally, a sweeping machine will include a hopper into which debris is swept by the brushes and subsequently dumped when desired. A scrubbing machine will include a solution tank and mechanism for applying the solution to the floor surface.

Despite the extensiveness of the prior art, certain problems continue with the various types of maintenance machines. For example, if a scrubbing machine is used to scrub a floor surface, for obvious reasons a sweeping machine should be used on the surface prior to the scrubbing of the surface. This, however, entails additional labor and time which often proves a significant expense. Scrubbing machines generally use squeegees to pick up the scrubbing solution. Often times there occurs undesirable squeegee streaking or fouling when debris which was not swept up is caught along or under the bottom edge of the squeegee. After the sweeping operation, additional debris may accummulate on the floor by various means and cause squeegee streaking during the scrubbing action. Again, added time and expense result when the machine is not as efficient as it might be. Another problem with some machines, especially combination sweeping-scrubbing machines, is the inability of the operator to visually check the operating elements, i.e. the brushes, to ensure that they are properly positioned and not jammed or otherwise malfunctioning. Illustrative of prior art maintenance machines are: the sweeping machine described in U.S. Pat. No. 3,837,157 (Van Der Lely) issued Sept. 24, 1974; a floor scrubber illustrated in U.S. Pat. No. 3,701,177 (Meyer, et al.) issued Oct. 31, 1972; and a combination scrubbing and sweeping apparatus described in U.S. Pat. No. 4,041,567 (Burgoon) issued Aug. 16, 1977 and U.S. Pat. No. 4,009,500 (Ashton) issued Mar. 1, 1977.

SUMMARY OF THE PRESENT INVENTION

In the present invention the above mentioned problems are addressed and advantageous results have been achieved. In a combination sweeping and scrubbing machine, the present invention includes disc brushes and mechanisms for applying scrubbing solution near the center of the brushes or just forward of the brushes. The brushes simultaneously sweep and scrub the floor surface. The present machine has a debris hopper constructed and arranged to receive and contain the debris swept forwardly by the disc brushes. A flexible ramp is positioned intermediate the hopper and the brushes. The flexible ramp is positioned at an angle which facilitates the upward movement of the debris into the hopper.

The machine of the present invention may be either a riding unit or a walk behind unit. A pair of disc brushes (or other disc tools such as a polishing pad) desirably are both driven so as to rotate in the same rotational direction. A leading disc brush is positioned slightly ahead of a second brush in a substantially side-by-side relationship. The brushes are constructed so that the leading brush determines the direction of rotation, which in accordance with the present invention is in the same direction as the trailing brush. A plurality of brushes could also be used.

A removable debris hopper is positioned in a housing or frame which is secured to the forward end portion of the machine. Preferably, the hopper is in a position just forward of the disc brushes. The hopper has a rearward opening facing the disc brushes. The frame and hopper may be unitary (i.e. a single part) providing it is easily removable.

A debris receiving mechanism is mounted at the rear of the hopper adjacent the forward edges of the brushes for directing debris swept forwardly by the brushes into the hopper opening. Included in the debris receiving mechanism is a flexible member or ramp having a bottom edge adjacent the floor surface. The ramp may be slit to facilitate debris passing therethrough and beneath to the brushes. The flexible member desirably is positioned at an upward and forward slope of a minimum angle. In a commercially workable embodiment the flexible member is positioned at a thirty-degree angle. This slope has been found to advantageously direct the upward movement of the swept debris into the hopper much in the manner of a ramp. The length of the flexible member desirably is disposed perpendicular to the path traversed by the machine. Also, the flexible member is located close to the leading brush.

Another aspect of the debris receiving mechanism is a conduit or inlet portion having a downwardly sloping surface. The conduit is positioned near the forward edge of the leading disc brush to receive and direct debris thrown substantially sideways and slightly forwardly by the brushes, into the hopper.

It has also been found advantageous to position a pair of flexible blade members to the frame or housing portion of the invention on either side of and beneath the hopper in a location forward of the flexible ramp. Each blade is positioned at an angle oblique to the generally forward direction of travel of the machine. The blades, which can be of rubber or other flexible material, serve to move and guide debris towards the center of the path being swept, insuring a complete sweeping of the full scrubbing path the first time. Each blade member may have a flexible portion extending beyond the periphery of the frame and hopper which will allow close sweeping and scrubbing of a wall area and near immovable objects.

An access area to the interior of the debris hopper may be provided in the top portion or cover of the hopper. This area or opening allows visual inspection of the operating brushes and convenient determination of any jamming occurring in the debris receiving area of the hopper. The access opening also allows the operator to manually insert debris into the hopper and allows a fast and easy way to determine when the hopper should be emptied. The opening may also serve as a hand-hold for assisting the operator in lifting and lowering the hopper during the emptying of the debris.

BRIEF DESCRIPTION OF THE DRAWINGS

In the drawings:

FIG. I is a perspective view of a floor maintenance machine employing the forwardly positioned debris hopper of the present invention.

FIG. II is a top plan view of a portion of the present invention as viewed with the hopper removed.

FIG. III is a cross-sectional view of the present invention as seen along lines III—III in FIG. I.

FIG. IV is a cross-sectional view of the present invention as seen along lines IV—IV in FIG. III.

FIG. V is a perspective view of a portion of the present invention as viewed from the floor surface near the disc brushes of the machine.

FIG. VI is a top plan view of a portion of a floor maintenance machine illustrating a second embodiment of the present invention.

FIG. VII is a schematic top plan view of a third embodiment of the present invention.

FIG. VIII shows a portion of a disc brush including auxiliary bristles.

FIG. IX shows an embodiment of the present invention includng a single disc brush.

DETAILED DESCRIPTION OF THE PRESENT INVENTION

The present invention relates to surface maintenance machines which simultaneously sweep and scrub a surface in one operation. The maintenance machine 10 may be of a general design as shown in FIG. I. It should be understood however that the present invention is equally applicable to a riding unit as well as the walk-behind unit of FIG. I.

The surface maintenance or cleaning unit 10, of the present invention includes a body 11 supported on the floor surface by a plurality of wheels 12 which allow movement of the machine or unit 10 across the floor surface. The machine or unit may have a steering mechanism 13 for control by the operator of the direction of travel of the unit 10. Within the body 11 is a power source 15 (e.g. a propelling motor) for driving the unit 10. A tank 16 for containing scrubbing solution and mechanism 17 for applying the solution to the maintained surface may also be found within the body of the machine. These aspects are conventional and thus are not specifically illustrated in the drawings nor further described except as their structure relates directly to the operation of the present invention.

The maintenance machine 10 of FIG. I has an end portion designated by the numeral 18 as the front portion of the machine. Disc tools, for example brushes are positioned beneath the front portion 18 of the machine. In the preferred embodiment the disc brushes may include a pair of overlapping, free-floating brushes arranged in a substantially side-by-side arrangement. A first or right hand brush **20*a*, as viewed from the operator's position (FIG. II), is disposed slightly ahead of the second or left-hand brush 20*b* for reasons to be explained hereinafter in the operation of the invention. Throughout this discussion the right-hand brush 20*a* will be referred to as the leading or forwardmost brush and the left-hand brush 20*b* as the trailing or rearwardmost brush. The disc brushes 20*a*, 20*b* may be of a standard design known to those skilled in the art. Alternatively the disc brush, such as 20*a*, may have an auxiliary set of bristles 20*c*** as shown in FIG. VIII around the brush periphery to assist in lifting debris. Abrasive cleaning or buffing pads may also be used. It should be understood, however, that the left-hand brush could be positioned as the leading brush with appropriate changes being made in the front portion of the machine for this alternate brush arrangement.

For reasons which will become clear hereinafter, the brushes are constructed and arranged on the unit so that in operation they will rotate in the same rotational direction. This direction will be determined by the position of the leading brush **20*a*. For example, if the leading brush is the right-hand brush as in the preferred embodiment, the rotational direction of the trailing brush 20*b* will be with the forewardmost edge moving towards the leading brush and hence a clockwise rotation (FIG. II). The leading brush 20*a*** would then rotate in a clockwise direction also.

In addition to the foregoing brush arrangement, the present invention further includes a housing or frame 21 which is attached to the front end portion 18 of the machine 10 directly in front of the disc brushes **20*a*,20*b* (FIGS. I, III and IV). In the preferred embodiment a frame structure 21 is used and includes a generally C-shape configuration constructed of structural material, e.g. angle iron members, with the flange portion of the member facing inwardly and generally towards the front end portion 18 of the machine. The horizontal leg portion 22 of the frame serves as a support for a removable debris hopper. Portion 22 may be supported by roller 25*a***.

The C-shape configuration of the frame in the preferred embodiment includes a left-hand side extension **23*a*, a right-hand side extension 23*b*, and a forwardmost side 23*c*. The forwardmost side 23*c* is connected at either of its ends to a respective side extension 23*a*,23*b* by obliquely arranged portions 23*d* shorter in length (FIG. II). Both of the left and right-hand side extensions 23*a*,23*b* are designed to be of sufficient length such that when each is secured to the machine body 11, the extension will provide adequate support for the remainder the frame and the hopper carried therein. Also, one or more swivel casters 25*a* may be provided under the frame which will carry the majority of the frame weight in order to correct any balancing problems which might occur on downward grades. The correct height for any windrow flaps used in the invention may be set by the individual casters. The frame may be secured to the machine by any suitable mechanism such as welding, bolting, etc. As can be seen in FIGS. II and III, the frame structure 21 does not cause any significant or noticeable change in the overall width of the maintenance machine 10**. The dimensions and configuration of the frame will of course be determined by the size of the machine and the desired capacity of the debris hopper.

A debris hopper 24 (FIGS. I and IV) for containing the debris swept up by the disc brushes **20*a*,20*b* is designed so that it is adjustable and fits snugly within the frame structure 21. If desired, the hopper may be securely mounted to the frame by bolts or screws, or other suitable mechanisms. It is important however that the hopper 24 be removably secured within the frame 21** so that the operator of the machine may conveniently dump the hopper of its contents when-ever necessary.

From FIG. V the overall design of the hopper in the preferred embodiment may be best understood. The hopper includes a base or floor 24*a* upon which the collected debris rests within the hopper. A rearward portion of the base 24*a* is cutaway and is left as an opening for reasons to become apparent hereinafter. Extending upwardly from and along the perimeter of the base 24*a* are left and right-hand sides 24*b*,24*c* as well as a front side 24*d*. The positional relationship of the sides to each other follow that of the C-shape configuration of the frame 21. This is to insure a close and secure fitting of the hopper 24 within the frame 21. A top portion or cover 46 rests upon or if desired may be secured along and to the uppermost edges of each of the hopper sides 24*b*,24*c* and 24*d*.

The back or rearward side of the hopper positioned close to the machine front end portion 18 is substantially open. A rearward opening 25 in the backside is defined by right and left-hand rear end portions 26,27 respectively which extend inwardly towards each other.

As can be seen in FIG. III the end portions 26,27 extend inward towards each other from respective right and left-hand sides 24*c*,24*b* of the hopper 24. The end portions 26,27 are designed to limit the width of the hopper's rearward opening 25 to retain debris in the hopper 24. In addition a debris pick-off point is provided by the free inside edge 26*a* of end portion 26 to direct debris into the hopper 24.

In the preferred embodiment the right side end portion 26 is a straight member portion, see FIG. III. The end portion 26 is spaced apart a sufficient distance from the brush so as to not obstruct the rotation of the brush tip. The free inside edge 26*a* of the end portion 26 may be terminated at a point substantially directly across from the forwardmost edge 29 of the leading brush 20*a*. The left side end portion 27 is substantially rectangular in shape and extends inwardly at a right angle with respect to the hopper left-hand side 24*b*. The end portion 27 may extend inwardly a short distance for structural strength (FIG. III).

The rearward opening 25 of the hopper (FIGS. III and V) faces the disc brushes 20*a*,20*b*. Secured to the base 24*a* along its cutaway portion and along the opening 25 is a debris receiving mechanism which assists in the upward movement of the swept debris into the hopper. The debris receiving mechanism includes in the preferred embodiment a three-sided conduit or channel-like arrangement 28 mounted close to the forwardmost edge 29 of the leading brush 20*a* (FIGS. III and IV). A first side or right-hand side is a generally vertical member 28*a* which is mounted to a bottommost edge of the hopper right side end portion 26. A second side or left-hand side of the conduit is a flat, generally triangular shaped member 28*b* which is secured to the cutaway portion of the hopper base 24*a*. Connecting the two sides 28*a*,28*b* is a central side or surface 31 which extends from its securement to the hopper 24*a*, downwardly towards the disc brushes 20*a*,20*b* to a location closely adjacent the floor surface. This surface portion 31 is designed to slope at an angle which will catch debris thrown substantially sideways and slightly forward by the leading brush 20*a* and serve as a ramp for directing the debris into the hopper 24.

Also included in the debris receiving mechanism is a generally elongated flexible member or ramp 32 (FIGS. III, IV and V). One end 33 of the flexible member 32 is positioned so as to be in contact with the debris conduit lefthand side 28*b*. The ramp 32 extends substantially along the full width of the hopper rearward opening 25 and is also secured to the hopper base 24*a* along the cutaway edge portion. This positioning places the member 32 directly in front of the greater portion of the pair of disc brushes 20*a*,20*b* (FIG. III). In the preferred embodiment the flexible ramp 32 is provided with spaced apart slit portions 34 which serve to facilitate the debris traveling beneath the ramp 32 for sweeping by the disc brushes 20*a*,20*b*. Of course, other modifications in the flexible ramp member 32 are possible for allowing debris to pass therethrough. The ramp 32 is positioned close to the floor surface in order to provide a sealed area for the sweeping operation, thus any means for allowing debris to pass through the ramp must be designed to function without significantly diminishing the sealing performance of the flexible member or ramp 32. The flexible ramp 32 may be made of any suitable material such as rubber and may be secured to the hopper by standard securement mechanism such as bolts and nuts, rivets, etc.

It has been found advantageous to secure the ramp 32 to the hopper opening 25 such that the bottom edge 35 of the ramp 32 is adjacent to the floor surface and the ramp 32 is positioned at an acute upward angle 36 forward of the bottom edge with respect to the horizontal plane of the floor surface. Preferably the angle of placement is less than forty-five degrees, and generally the smallest practical angle of about thirty degrees has been found to be the most efficient. The angle positioning of the ramp is chosen to allow sufficient clearance for debris to pass thereunder, but at a minimum slope which will permit debris to rise upwardly along it into the hopper opening. The angled ramp effectively serves as a ramp for catching and directing swept-up debris into the hopper as will be explained hereinafter.

Directly forward of the debris receiving mechanism and beneath the hopper may be positioned a pair of blades 37,38 mounted to opposite sides of the frame structure 21 (FIG. II). The blade 37 forward of the leading brush 20*a* is generally of a greater length than the blade 38 forward of the trailing brush 20*b*. Each blade 37,38 is arranged at an angle oblique to the generally forward direction of travel of the machine. An effective angle, as designated by the numeral 39 in FIG. II, is about thirty degrees. However, other angles may prove satisfactory, with steeper angles being the most effective.

Each blade 37,38 is mounted in a manner which allows it to direct or push debris to a central area of the machine's path of movement. In this way, the blade acts as a windrow device for accomplishing full machine width sweeping without additional passings of the machine over the same surface area. To assist in accomplishing the full width sweeping, each blade 37,38 includes a flexible end portion 41,42, respectively, which extends outwardly beyond the sides 23*a*,23*b*, respectively, of the frame structure 21. The flexible end portions 41,42 allow the machine to sweep close to walls and/or immovable objects while still achieving a full width sweep of the area. A pair of side rollers 43*a* and 43*b* serve to guide the scrubber along vertical surfaces, e.g. walls, to protect the machine and wall from damage.

Further, the debris hopper 24 may be provided with an access area or opening 45 which allows the operator a visual inspection of the interior of the hopper as well as observation of the operation of the disc brushes. The operator is thus able to determine if any blocking of the receiving mechanism is occurring and if the disc brushes are rotating properly. The opening may be large enough to allow the operator to manually insert objects into the hopper. The access opening may also serve to allow the operator to grasp the hopper and remove it from the frame structure for dumping. A preferred embodiment would be an opening 45 with downward flanges 47 to reduce the chances of debris bouncing out of the hopper. The flanges would also add strength to the opening for the purpose of lifting the hopper. A hinged door with a handle or a flexible slit flap are optional add-ons. The door may be transparent to permit visual observation of the contents.

Various modifications may be made without departing from the broader scope of the present invention. For example, one may desire to place the left-hand brush in the forwardmost position with the right-hand brush as the trailing brush. The rotational direction of travel for this particular embodiment would then be counterclockwise. The right-hand or trailing brush would be driven so as to rotate towards the left-hand or leading brush and therefore in a counterclockwise direction, with the left-hand brush rotating counterclockwise as well. The present invention is not limited by the determination of which brush is the leading brush. It is desirable in the present invention that one brush be positioned slightly ahead of the other brush and that the brushes rotate in the same rotational direction. Various modifications may be made. For example a plurality of brushes or other types of cleaning tools may be used. Also, the present invention is not limited to a unit having two brushes or tools. For example, the present invention may have only a single brush as shown in FIG. IX or may have more than two brushes, e.g. three brushes.

If desired, liquid drain openings (not shown) may be provided in portions of the debris hopper to allow quantities of scrubbing solution which are swept up with the debris to be drained from the hopper. This may be desirable for obvious reasons not the least of which would be to diminish the chances that the operator will spill accumulated solution on the clean floor surface when the hopper is being emptied. Additionally, a vacuum hose or other type of mechanism may be mounted in the debris hopper to remove the scrubbing solution.

A second embodiment of the present invention is shown in FIG. VI. In this embodiment a squeegee 80 is located at the rearward end of the maintenance machine 81. The rotating disc brushes 82 and 83 are mounted directly in front of the rearward squeegee 80, rather than at the front end of the machine as in the first embodiment. As can be seen in FIG. VI a pair of brushes is employed with the right hand brush 82 placed slightly ahead of, but substantially side-by-side, the left-hand brush 83. As in the preferred embodiment the leading brush 82, i.e. the right-hand brush, determines the direction of rotation for the two brushes. The trailing brush 83, i.e. the left-hand brush, thus sweeps in a direction generally towards the forward edge of the leading brush or clockwise in this particular arrangement. Of course, as a matter of design choice, the left-hand brush could be selected as the leading brush, and then the direction of rotation for the pair of brushes would be counterclockwise.

In the embodiment shown in FIG. VI, the hopper 84 is positioned beneath the body of the machine at a location directly ahead of, yet adjacent to, the forwardmost edge of the leading brush 82. As a practical matter, the hopper 84 is constructed so that it may be slid into position and thus suspended beneath the machine body and secured in that position relative to the disc brushes 82, 83, by appropriate securing means. In all other respects the hopper and debris receiving means are substantially identical to the hopper and means disclosed and described in the foregoing discussion of the preferred embodiment. Except, of course, no access opening need be provided in the top or cover for obvious reasons.

A third embodiment of the invention is illustrated schematically in FIG. VII. In this embodiment a plurality of disc brushes are used. The brushes are arranged in a V-formation with a forwardmost pair of brushes 120 and 121, spaced apart from each other but substantially side-by-side forming the opening of the V-shape. Along either side of the V-shape arrangement at least one more brush **120*a* and 121*a* respectively is secured slightly behind and to the inner side of the forwardmost brush located directly ahead. In this embodiment one additional brush 120*b* is shown, centered between and slightly rearwardly of brushes 120*a* and 121*a*. The brushes each rotate in a direction which will cause debris to be swept forwardly by the brushes towards the hopper mounted, as in the preferred embodiment, directly in front of the forwardmost brushes. In the schematic illustration it can be better appreciated that the forwardmost brushes rotate in opposite directions, with the right hand brush rotating in a clockwise direction and the left-hand brush rotating in a counterclockwise direction. The brushes mounted directly behind each of the forwardmost brushes rotate in the same direction as the respective forwardmost brush ahead of it. The center brush 120*b* may be rotated in either direction. The hopper 124 in this third embodiment and the debris receiving mechanism 128 are substantially identical to that described in the foregoing discussion of the preferred embodiment, however, the debris receiving mechanism 128 has a ramp member 132 with a pair of end chutes 133 and 134. The single brush machine 181 (FIG. IX) may include a squeegee 180, a disc brush 183 and a removable hopper 184**.

OPERATION OF THE INVENTION

Referring again to FIGS. I through V for illustrative purposes, in the operation of the maintenance machine 10, scrubbing solution is dispensed from the tank 16 to the rotating disc brushes **20*a*, 20*b*. As the solution reaches the floor surface it will be used by the rapidly rotating brushes 20*a*, 20*b*** to scrub the floor surface. It is highly desirable to have all possible debris on the floor surface removed. Typically, combination sweepers and scrubbers have employed vacuums to assist in removing the debris to a container generally positioned in the body and behind the brushes. For various reasons, such arrangements have proven less than satisfactory in their efficiency for removing debris which if left on the floor surface can cause squeegee streaking and plugging of the vacuum system.

The present invention affords a unique solution to such prior art problems by the placement of the debris hopper 24 ahead of the sweeping brushes 20*a*, 20*b*. The unique debris receiving mechanism along with the debris guiding blades 37, 38 function to achieve virtually complete removal of debris swept up by the brushes. This is accomplished in the following manner.

As the machine 10 is moved along the floor surface the blades 37, 38 catch the debris. The continued movement of the machine causes the debris to move inwardly along the respective blade to a central portion of the path being swept. When the debris finally arrives at the open central portion, the flexible ramp 32 then passes over the accumulated debris. The debris next contacts the rotating brushes 20*a* and/or 20*b* which typically rotate from approximately 160 rpm (revolutions per minute) up to 400 rpm or higher, with a common brush tip speed being 1340 fpm (feet per minute).

Any debris which is contacted by the rotating trailing brush 20*b* is thrown either forwardly to the sloping ramp 32 where it is guided into the hopper opening 25 or it may be thrown from brush 20*b* to the leading brush 20*a* which then gives the debris additional momentum to be thrown more easily into the debris hopper through the conduit 28 (FIG. III). The action of the leading brush 20*a* upon the debris may be likened to a catapult-like assist to the movement of the debris into the hopper. This catapult-like increase in momentum will occur even if the leading brush is the left hand brush.

Debris which does not first contact the trailing brush 20*b*, instead passes directly to the leading brush 20*a*. The leading brush 20*a* is closer to the debris hopper 24 and the conduit means 28 and thus the debris is less likely to escape entry into the hopper. The conduit 28 positioned directly in front of the forward edge 29 of the rotating leading brush 20*a* will catch debris which gets thrown sideways and prevent it from merely hitting a closed portion of the hopper and falling back to the floor surface where it must again be swept. It is to be recognized that the embodiments shown in FIGS. VI and VII operate in a manner similar to the embodiment of FIGS. I–V.

With an almost complete removal of debris by the present invention, the subsequent scrubbing action of the brushes is also made more efficient. As a natural result there is far less squeegee streaking and the appearance of the scrubbed surface is greatly enhanced. Also, when satis- a single pass of the machine over any given surface area. A significant savings in time and labor may then be realized.

With the proper relationship of the leading brush to the conduit as well as the relative slope of the flexible ramp to the floor surface, the present invention proves reliable for collecting and containing debris. It is constructed from low cost components and easily adjusted and readily removed from the machine. Fast, safe visual inspection and emptying of the hopper area is possible and convenience to the operator of the machine is greatly increased.

Of course, it will be appreciated by those skilled in the art that various modifications may be made in the invention as disclosed without departing from the broader scope of the present invention as set forth in the claims which follow hereinafter. For example the present invention has been described in an embodiment wherein the disc tool is a disc brush. However, the tool may be a scarifying tool or polishing pad.

What is claimed is:

1. A maintenance machine used to simultaneously sweep and scrub floor surfaces, comprising movable body means including a forward end, at least two substantially side-by-side disc brushes carried by said body means, said brushes including a forwardmost brush positioned slightly ahead of a rearwardmost brush, said brushes rotating in the same rotational direction as determined by the forward edge of the forwardmost brush with said rearwardmost brush sweeping generally towards the forwardmost brush; a housing attached to said forward end, said housing comprising a rearwardly opening hopper for containing debris swept therein by said brushes; and means for receiving debris, said receiving means being mounted intermediate said hopper and said brushes adjacent said rearward opening for receiving debris swept forwardly by said brushes.

2. The maintenance machine in accordance with claim 1 wherein said debris receiving means includes conduit means positioned near the forward edge of the forwardmost disc brush, including an inlet portion having a generally downwardly and rearwardly sloping surface for directing debris into said hopper.

3. The maintenance machine in accordance with claims 1 and 2 wherein said debris receiving means further includes a generally elongated, flexible member sloping downwardly and rearwardly to a line adjacent said floor surface, said flexible member serving to permit debris to pass therebeneath to said brushes as the machine moves over the floor surface and serving as a ramp for the debris swept forwardly by said brushes toward said hopper adjacent said brush forward edges.

4. The maintenance machine in accordance with claim 3 wherein said flexible member is positioned generally lower than said hopper near the surface of the floor at an acute angle with respect to the floor surface.

5. The maintenance machine in accordance with claim 4 wherein said flexible member includes a bottom edge adjacent the floor surface, and said member is positioned at an angle less than forty-five degrees forward of said bottom edge with respect to the horizontal plane of the floor surface.

6. The maintenance machine in accordance with claim 4 wherein said flexible member includes a bottom edge adjacent the floor surface and said member is positioned at about a thirty degree angle forward of said bottom edge with respect to the horizontal plane of the floor surface.

7. The maintenance machine in accordance with claim 4 further including at least one debris blade member supported with respect to said housing, said blade member being disposed forwardly of said flexible member, and positioned at an angle oblique to the generally forward direction of travel of the machine, said blade member serving to move debris toward the center of the path being swept.

8. A floor maintenance machine comprising a body supported on a plurality of wheels; disc brush means disposed at the forward end of the machine for sweeping at least one pathway; a debris hopper; a frame positioned forwardly of said disc brush means and constructed and arranged for removable securement of said debris hopper therein; a debris conduit and a flexible member secured with respect to said hopper immediately forward of said disc brush means, said member having an end portion located adjacent said debris conduit and a generally elongated body portion having means therein for allowing debris to travel therethrough to said brush means, said flexible member providing a ramp for debris swept forwardly to enter said hopper.

9. The floor maintenance machine in accordance with claim 8 further including at least one blade member secured to said frame principally beneath said hopper and forward of said flexible member, said blade member being positioned at an angle oblique to the generally forward direction of travel of the cleaning unit, and serving to move debris toward the center of said maintenance machine path of movement.

10. The floor maintenance machine in accordance with claim 8 wherein said debris conduit includes inlet means for directing debris into said hopper, said inlet means including a portion sloping downwardly in a direction generally towards said disc brush means.

11. In a floor surface cleaning unit, including a body supported on a plurality of wheels, the improvement comprising:

a frame mounted on said cleaning unit;

a debris hopper removably secured within said frame;

a leading disc brush and a trailing disc brush, each of said brushes adapted for operable connection to the cleaning unit, said trailing brush constructed and arranged to rotate the forward edge of said brush in a direction generally toward said leading brush, said leading brush being constructed and arranged to rotate in the same direction as said trailing brush;

a debris conduit mounted to said hopper adjacent to and in front of said leading disc brush;

at least one debris blade mounted to said frame principally beneath said hopper and apart from said brushes at an angle oblique to the normal direction of forward travel of the cleaning unit; and a flexible ramp secured to said hopper adjacent said debris conduit, intermediate said brushes and said blade, said ramp directing debris into said hopper allowing debris to pass therethrough to said brushes.

12. The cleaning unit in accordance with claim 11 wherein said flexible ramp includes a bottom edge, said ramp being secured to said hopper so as to slope downwardly and rearwardly at an acute angle forward of said bottom edge with respect to the horizontal plane of the floor surface.

13. The cleaning unit in accordance with claim 12 wherein said flexible ramp includes a bottom edge adjacent the floor surface and is positioned at an angle less than forty-five degrees forward of said bottom edge with respect to the horizontal plane of the floor surface.

14. The cleaning unit in accordance with claim 12 wherein said flexible ramp includes a bottom edge adjacent the floor surface, and said ramp is positioned at about a thirty degree angle forward of said bottom edge with respect to the horizontal plane of the floor surface.

15. A mobile cleaning unit used to simultaneously scrub and sweep a floor surface, said unit including a body structure having a forward end portion and being supported by means for moving said unit across a floor surface, a power source for driving said unit, a tank for containing scrubbing solution, means for applying said solution to a surface to be scrubbed, and at least two substantially side-by-side disc-shaped floor maintenance tools, one of said tools being positioned slightly ahead of said other tool with both tools rotating in the same rotational direction, means for collecting debris swept forwardly by said rotating tools, said collecting means comprising:

a housing removably secured to said body structure forward end portion, said housing including a rearwardly opening hopper for containing debris swept forwardly by said tools; and, means on said hopper for receiving debris swept forwardly by said tools, said receiving means constructed and arranged to serve as a ramp for directing debris into said hopper.

16. In the cleaning unit of claim 15, the improvement wherein said debris receiving means includes an inlet portion having at least one surface sloping downwardly generally towards said tools and constructed and arranged to facilitate the upward movement of the debris into said hopper.

17. In the cleaning unit of claim 16, the improvement wherein said receiving means further includes a flexible member having a bottom edge disposed generally near the surface of the floor and at an acute angle forward of said bottom edge with respect to the horizontal plane of the floor surface.

18. The cleaning unit of claim 17, wherein said sloping surface is positioned at an angle less than forty-five degrees forward of said bottom edge with respect to the horizontal plane of the floor surface.

19. The cleaning unit of claim 17, wherein said sloping surface includes a bottom edge adjacent the floor surface, and said sloping surface is positioned at about a thirty degree angle forward of said bottom edge with respect to the horizontal plane of the floor surface.

20. The cleaning unit of claim 15, further including a pair of blade members disposed generally opposite each other and forward of said debris receiving means, each of said blade members being secured to said housing beneath said hopper at an angle oblique to the generally forward direction of movement of said unit.

21. The mobile cleaning unit of claim 20 wherein at least one of said tools comprises a disc brush.

22. The mobile cleaning unit of claim 21 wherein at least one of said brushes includes an auxiliary set of bristles to assist in lifting debris.

23. The mobile cleaning unit of claim 20 wherein at least one of said tools comprises a disc pad.

24. A maintenance machine used to simultaneously sweep and scrub a floor surface, comprising movable body means including a rearward end, a squeegee mounted at said rearward end, at least two substantially side-by-side disc brushes carried by said body means, said brushes being diposed immediately forward of said squeegee, said brushes rotating in the same rotational direction; a housing positioned beneath and attached to said body means near said brushes, said housing comprising a rearwardly opening hopper for containing debris swept forwardly therein by said brushes; and means for receiving debris swept forward by said brushes, said receiving means being mounted intermediate said hopper and said brushes and adjacent to said rearward opening.

25. A maintenance machine used to simultaneously sweep and scrub a floor surface, comprising movable body means including a forward end, a plurality of disc brushes carried by said body means, said brushes including a pair of forwardmost brushes spaced apart in a substantially side-by-side relationship, said forwardmost brushes rotating in opposite directions, said plurality of brushes further including at least two rearwardmost brushes each positioned slightly behind a respective forwardmost brush and generally side-by-side and closer together with respect to said respective forwardmost brushes, said rearwardmost brushes each rotating in the same direction as said forwardmost brush positioned directly ahead thereof; a housing attached to said forward end, said housing comprising a rearwardly opening hopper for containing debris swept therein by said brushes; said hopper having at least one rearward opening adjacent said forwardmost brushes; and means for receiving debris swept forwardly, said receiving means being mounted intermediate said hopper and said forwardmost brushes and adjacent to said rearward opening of said hopper.

26. The maintenance machine in accordance with claim 24 or 25 wherein said debris receiving means further includes a generally elongated, flexible member sloping downwardly and rearwardly to a line adjacent said floor surface, said flexible member constructed and designed to permit debris to pass therebeneath to said brushes as the machine moves over the floor surface and serving as a ramp for the swept debris to enter said hopper.

27. The maintenance machine in accordance with claim 26 wherein said flexible member includes a bottom edge adjacent the floor surface, said member being positioned at an angle less than forty-five degrees forward of said bottom edge with respect to the horizontal plane of the floor surface.

28. A maintenance machine for simultaneously sweeping and scrubbing a floor surface, said machine comprising movable body means, disc brush means carried by said body means, and removable hopper means disposed immediately forward of said disc brush means, said hopper means including ramp means for receiving debris projected from said disc brush means, said hopper being readily removable for dumping of said debris.

29. The maintenance machine of claim 28 wherein said machine includes a squeegee disposed at the rear portion of said machine, said disc brush means and said hopper means being disposed immediately forwardly of said squeegee.

30. A maintenance machine for simulaneously sweeping and scrubbing a floor surface, said machine comprising movable body means, disc brush means carried by said body means, and removable hopper means disposed immediately forward of said disc brush means, said hopper means including ramp means for receiving debris projected from said disc brush means, said disc brush means comprising a pair of side-by-dide disc brushes.

31. The maintenance machine of claim 28 wherein said disc brush means comprise a single disc brush.

32. A maintenance machine comprising a body supported on a plurality of wheels; disc tool means for maintenance of at least one pathway; a debris hopper opening rearwardly; a frame positioned forwardly of said disc tool means, said frame being adapted to support said debris hopper in a manner to allow periodic removal of debris from said hopper; said debris hopper including means for receiving debris thrown forwardly by said disc tool means, said debris receiving means being disposed between said rearward opening and said disc tool means.

* * * * *